US006932461B2

(12) United States Patent
Usami et al.

(10) Patent No.: US 6,932,461 B2
(45) Date of Patent: Aug. 23, 2005

(54) INK-JET RECORDING HEAD

(75) Inventors: Hiroyuki Usami, Ebina (JP); Yoshinao Kondoh, Ebina (JP); Hiroshi Ikeda, Ebina (JP); Nanao Inoue, Ebina (JP); Shuichi Yamada, Ebina (JP); Naoki Morita, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 104 days.

(21) Appl. No.: 10/629,900

(22) Filed: Jul. 30, 2003

(65) Prior Publication Data

US 2004/0119789 A1 Jun. 24, 2004

(30) Foreign Application Priority Data

Dec. 16, 2002 (JP) ..... 2002-364052

(51) Int. Cl.[7] ..... B41J 2/05
(52) U.S. Cl. ..... 347/61
(58) Field of Search ..... 347/61, 56, 55, 347/54, 20, 86, 85, 84, 1, 5, 7, 9

(56) References Cited

U.S. PATENT DOCUMENTS 6,161,924 A 12/2000 Mitani et al.

2003/0058308 A1 * 3/2003 Yamamoto ..... 347/64

FOREIGN PATENT DOCUMENTS

| | | |
|---|---|---|
| JP | 6-71888 | 3/1994 |
| JP | 6-238901 | 8/1994 |
| JP | 9-300623 | 11/1997 |
| JP | 10-16242 | 1/1998 |

* cited by examiner

*Primary Examiner*—Raquel Yvette Gordon
(74) *Attorney, Agent, or Firm*—Morgan, Lewis & Bockius LLP

(57) ABSTRACT

There are provided a structure of an ink-jet recording head comprising a substrate; a first conductive layer provided on the substrate; an insulating layer provided on the first conductive layer; a second conductive layer formed on the insulting layer and coming into contact with the first conductive layer; and a heat generation layer disposed on the second conductive layer and having, on a surface thereof, a self-oxidized protective film as an ink-contact interface, in order that metal conductive layer material having excellent energy efficiency and typified as aluminum, which is generally used as semiconductor material, can be used.

11 Claims, 3 Drawing Sheets

INK-JET RECORDING HEAD

CROSS-REFERENCE TO RELATED APPLICATION

This application claims priority under 35 USC 119 from Japanese Patent Application No. 2002-364052, the disclosure of which is incorporated by reference herein.

BACKGROUND OF THE INVENTION

1. Field of the Invention

The present invention relates to an ink-jet recording head using an ink-jet recording system.

2. Description of the Related Art

Conventionally, recording head structures of commercially-available thermal ink jet printers mostly utilize a laminated structure of tantalum (Ta) and an insulating film (SiN or $SiO_2$ film), as a heater protective film 102 on the surface of a heater 100 (see FIG. 3).

However, due to the heater protective film 102 (a tantalum laminated film) being formed on the surface of the heater 100, heat transmission from the heater 100 to ink is interfered by the heater protective film 102 (the tantalum laminated film), and energy efficiency (that is, a ratio at which input electric energy is converted to ink boiling energy) deteriorates, thereby resulting in an increase of electric power consumption.

For this reason, a structure as shown in FIG. 4 has been proposed in which a self-oxidized (protective) film 106 is formed on a heating resistor 104 (which is made out of TaSiO, CrSiO or the like) which serves as a heater, and the heater protective film 102 made of a tantalum laminated film as shown in FIG. 3 is not required (for example, see Japanese Patent Application Laid-Open (JP-A) No. 6-71888, FIG. 1; and JP-A No. 6-238901, FIG. 1).

Further, a technique is proposed in which nickel (Ni), nickel-gold (Ni+Au) are used as conductive layer materials so as to prevent a conductive layer 108 used to connect the heater 104 from being corroded by ink (for example, see JP-A No. 6-71888; JP-A No. 9-300623, FIG. 1; and JP-A No. 10-16242, FIG. 1).

However, nickel or a nickel compound has been known as a cancerating substance and has become a regulated substance based on Pollutant Release and Transfer Register Act. Thus, many restrictions are placed on these materials from the aspect of safety and environment. Therefore, it is not desirable to use them as industrial products in the future. On the other hand, aluminum conductive layer material is generally used as semiconductor process material, and workability and handling thereof are easy.

In a case in which aluminum is merely used in place of nickel, nickel-gold, only an oxide film having a film thickness of about 0.5 to 1.0 $\mu$m makes it possible to protect aluminum conductive layer material from corrosion by ink. This has a problem in terms of reliability.

SUMMARY OF THE INVENTION

In view of the aforementioned circumstances, an object of the present invention is to provide the structure of an inkjet recording head in which excellent energy efficiency is obtained and metal conductive layer materials as typified by Al, which are generally used as semiconductor materials, can be used.

A first aspect of the present invention is an ink-jet recording head which comprises: a substrate; a first conductive layer provided on the substrate; an insulating layer provided on the first conductive layer; a second conductive layer formed on the insulting layer and coming into contact with the first conductive layer; and a heat generation layer disposed on the second conductive layer and having, on a surface thereof, a self-oxidized protective film (layer) as an ink-contact interface.

In the present invention having the aforementioned structure, the heat generation layer is disposed on the second conductive layer formed on the insulating layer. Therefore, the self-oxidized protective film formed on the surface of the heat generation layer comes into contact with ink, and the second conductive layer does not come into contact with ink. Accordingly, it is not necessary to provide a protective layer such as nickel or nickel coated with gold for protecting the second conductive layer from corrosion by ink. Further, the heat generation layer and the second conductive layer come into contact with each other on the lower surface of the heat generation layer. Therefore, the second conductive layer is protected by the heat generation layer, and there is no possibility that the second conductive layer may be corroded by contact with ink.

A second aspect of the present invention is constructed such that, in the structure of the first aspect, at least one of the first and second conductive layers is metal which includes, as a principal component, aluminum Al or aluminum alloy.

In the aforementioned structure, due to the metal containing Al or aluminum alloy as a principal component being used for, preferably, the first and the second conductive layers, contact resistance (electric resistance) between the second conductive layer and the heat generation layer can be lessened.

A third aspect of the present invention is constructed such that, in the structure of the first aspect, wherein the heat generation layer is a TaSiO film.

In the aforementioned structure, since the heat generation layer is a TaSiO film, a self-oxidized protective film can be formed on the surface of the heat generation layer, thereby allowing the surface of the heat generation layer to be brought into contact with ink without forming the laminated protective films comprised of tantalum, an insulating films and the like on the heat generation layer. As a result, deterioration in heat efficiency of the heat generation layer can be prevented.

A fourth aspect of the present invention is an ink-jet recording head comprising: a substrate; a first conductive layer provided on the substrate; an insulating layer provided on the first conductive layer; a second conductive layer formed on the insulating layer and coming into contact with the first conductive layer; and a heat generation layer disposed on the second conductive layer and having, on a surface thereof, a self-oxidized protective film as an ink-contact interface, wherein a portion (a step-difference alleviating portion) is formed, which portion buries (alleviates) a stepped portion formed by an edge of the second conductive layer and the insulating layer.

In the aforementioned structure, the step-difference alleviating portion is formed at a stepped portion generated by the insulating layer and the edge of the second conductive layer formed on the insulating layer. The step-difference alleviating portion serves as a leveling portion for leveling the stepped portion formed between the insulating layer and the edge of the second conductive layer. As a result, breaking of a thin heat generation layer caused by an angled portion of the stepped portion can be prevented.

A fifth aspect of the present invention is constructed such that, in the structure of the fourth aspect, at least one of the first and second conductive layers is metal which includes, as a principal component, aluminum or aluminum alloy.

In the aforementioned structure, due to the metal containing Al or aluminum alloy as a principal component being used for, preferably, the first and second conductive layers, contact resistance (electric resistance) between the second conductive layer and the heat generation layer can be lessened.

A sixth aspect of the present invention is constructed such that, in the structure of the fourth aspect, the heat generation layer is a TaSiO film.

In the aforementioned structure, since the heat generation layer is a TaSiO film, a self-oxidized protective film can be formed on the surface of the heat generation layer, thereby allowing the surface of the heat generation layer to be brought into contact with ink without forming the laminated protective films comprised of tantalum, an insulating films and the like on the heat generation layer. As a result, deterioration in heat efficiency of the heat generation layer can be prevented.

A seventh aspect of the present invention is constructed such that, in the fourth aspect of the present invention, the step-difference alleviating portion is formed by laminated insulating films comprised of different compositions formed on the second conductive layer.

In the aforementioned structure, the step-difference alleviating portion is formed by removing most of the laminated insulating films formed on the second conductive layer by etching or the like and remaining the laminated insulating films at an edge of the second conductive layer. At this time, in order to prevent a stepped portion from becoming larger by etching or the like, a laminated structure by films by which an end point of insulating film removing operation can be detected is provided.

An eighth aspect of the present invention is a method for manufacturing an ink-jet recording head, comprising the steps of: forming a first conductive layer on a substrate; forming a first insulating film on the first conductive layer; forming a second conductive layer on the first insulating film; after forming a second insulating film comprised of at least one type of composition on the entire surface of the second conductive layer, etching the second insulating film to form a step-difference alleviating portion at a stepped portion formed by an edge of the second conductive layer and the first insulating film; and forming a heating resistor on the second conductive layer and on the second insulating film.

In the aforementioned structure, the second insulating film comprised of at least one type of composition is formed on the entire surface of the second conductive layer, and thereafter, the second insulating film is removed by etching to form a step-difference alleviating portion at a stepped portion formed by the second conductive layer and the first insulating layer, and an end point of etching can be detected. Further, by forming the heating resistor after the etching, contact (electric) resistance between the heating resistor and the conductive layer can be lessened. Moreover, although most of the second insulating film is removed by etching, a part of the second insulating film remains at an edge of the second conductive layer. Therefore, the stepped portion has a tapered structure. The tapered portion becomes the step-difference alleviating portion and breaking of the resistor can be prevented.

A ninth aspect of the present invention is constructed such that, in the eighth aspect, the second insulating film includes at least two types of insulating films comprised of different compositions, and when forming the step-difference alleviating portion (when etching the second insulating film), an amount of etching in the second insulating film is adjusted using the difference in compositions between insulating films.

In the aforementioned structure, the second insulating film is comprised of two types of insulating films having different compositions. For this reason, when end of etching for one of the insulating films can be detected at the time of etching, an amount of etching for the second insulating film can be precisely adjusted.

A tenth aspect of the present invention is an ink-jet recording cartridge equipped with the inkjet recording head according to the above-described first or fourth aspect.

In the aforementioned structure, due to the ink-jet recording head according to the first or fourth aspect being used, an ink-jet recording cartridge can be provided in which metal conductive layer material having excellent energy efficiency and typified by aluminum, which is generally used as semiconductor material, can be used.

An eleventh aspect of the present invention is an ink-jet recording device equipped with an ink-jet recording cartridge according to the tenth aspect.

In the aforementioned structure, due to the ink-jet recording cartridge according to the tenth aspect being used, an ink-jet recording device using an ink-jet recording cartridge can be provided in which metal conductive layer material having excellent energy efficiency and typified by aluminum, which is generally used as semiconductor material, can be used.

In a twelfth aspect of the present invention according to the eighth aspect, the step-difference alleviating portion is the second insulating film.

In a thirteenth aspect of the present invention according to the ninth aspect, the second insulating film comprises a third insulating film and a fourth insulating film formed on the third insulating film, and the amount of the etching of the second insulating film is adjusted by monitoring product generated by reaction of a part of components of the fourth insulating film and a part of components of etching gas.

DETAILED DESCRIPTION OF THE INVENTION

Figure 1A:
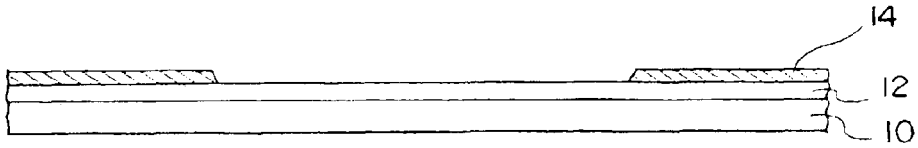
FIGS. 1A to 1H are cross-sectional views which show a method for manufacturing an inkjet recording head according to a first embodiment of the present invention.
Figure 1B:
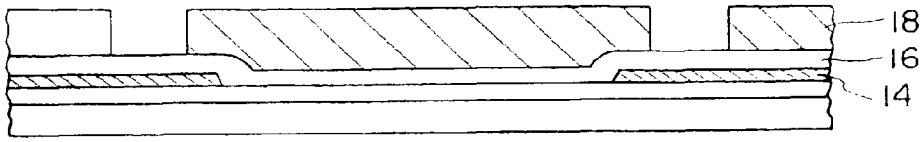
Figure 1C:
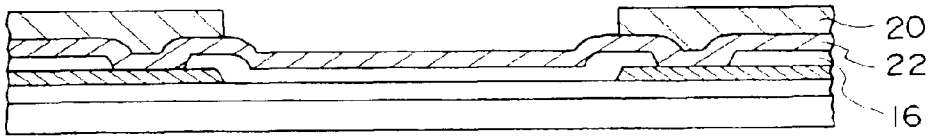

In FIGS. 1A to 1H, a method for manufacturing a recording head of an ink-jet printer (an ink-jet recording head) according to a first embodiment of the present invention is shown.

First, an oxide film 12 of 1 $\mu$m in thickness is formed on a silicon substrate. Thereafter, a first metal conductive layer 14 made of aluminum alloy is patterned so as to have a thickness of 0.7 $\mu$m (see FIG. 1A).

Subsequently, an interlayer insulating film 16 of 1 μm in thickness is formed. A photo-resist 18 (manufactured by Tokyo Ohka Kogyo Co., trade name: OFPR-800) is spin-coated on the interlayer insulating film 16, and subjected to exposure and development to carry out patterning (see FIG. 1B).

Next, dry etching using fluorine gas is carried out with the photo-resist 18 being used as a mask, thereafter, removing the photo-resist 18 by oxygen plasma and forming a contact portion in which the first metal conductive layer 14 is exposed in the interlayer insulating film 16. Further, a second metal layer 22 made of aluminum alloy and having a thickness of 0.5 μm is formed (deposited) thereon, and a photo-resist 20 is coated on the second metal layer (conductive layer) 22 and subjected to exposure and development to carry out patterning (see FIG. 1C).

Figure 1D:
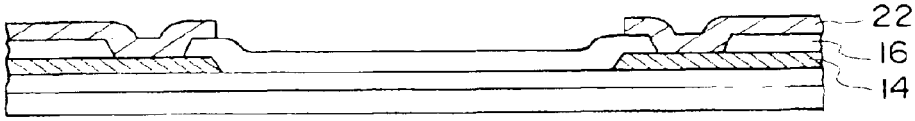

With the photo-resist 20 being used as a mask, drying etching using chlorine-based gas is carried out, thereafter, removing the photo-resist 20 (see FIG. 1D).

Figure 1E:
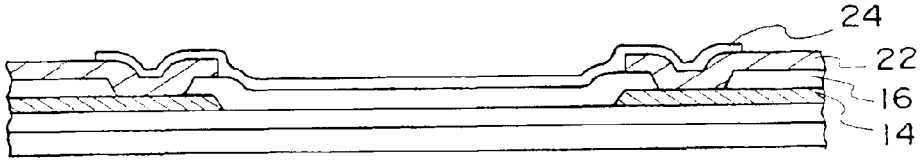
Figure 1F:
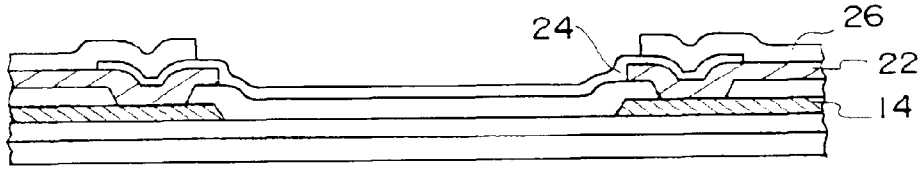
Figure 1G:
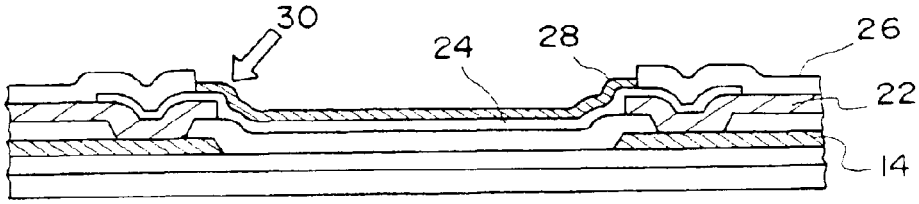

Thereafter, spattering (deposition) of a heating resistor 24 made of TaSiO is carried out so as to have a thickness of 0.1 μm (see FIG. 1E). Due to etching being carried out using fluorine-based gas with a resist (not shown) used as a mask, the heating resistor 24 is patterned to a desired size. Thereafter, the resist is removed.

Next, an interlayer insulating film 26 (protective film) of 0.7 μm in thickness is deposited and patterned by etching. This process allows a heat generation region of the heating resistor 24 to be defined (see FIG. 1F).

Heat treatment is carried out at the temperature of 450° C. or thereabouts for several tens of minutes in the presence of oxygen. A thin oxide film 28 (a self-oxidized protective film) is formed on a surface of the exposed heating resistor 24 (TaSiO) (see FIG. 1G).

Figure 1H:
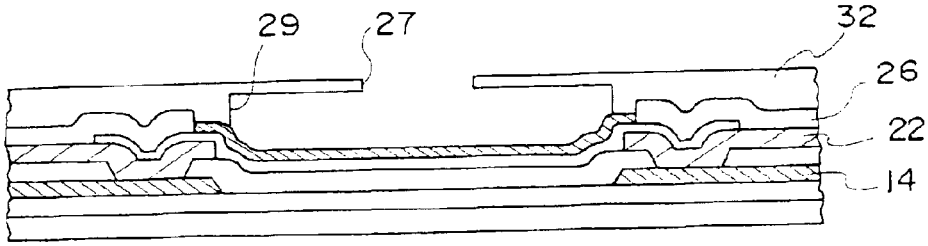

Finally, an ink flow channel 29 and a nozzle 27 are formed by resin 32 (see FIG. 1H).

In the present embodiment, the heat generation layer is disposed on the second conductive layer formed on the insulating layer. Therefore, a self-oxidized protective film formed on the surface of the heat generation layer comes into contact with ink, and the second conductive layer does not come into contact with ink. Accordingly, it is not necessary to provide a protective layer such as nickel or nickel coated with gold, which is used to protect the second conductive layer from corrosion by ink. Further, the heat generation layer and the second conductive layer come into contact with each other on the lower surface of the heat generation layer. Accordingly, the second conductive layer is protected by the heat generation layer and there is no possibility that the second conductive layer may be corroded due to coming into contact with ink.

In FIGS. 2A to 2H, a method for manufacturing an ink-jet recording head according to a second embodiment of the present invention is shown.

In the aforementioned first embodiment, the thickness of the heating resistor 24 is very small, that is, 0.1 μm. Therefore, there is a possibility that breaking of the heating resistor 24 may occur, particularly, in a stepped portion as indicated by arrow 30 of FIG. 1G. In the second embodiment of the present invention, a structure for alleviating this stepped portion (reducing the degree of this stepped portion) is provided at an edge of the metal conductive layer.

First, an oxide film of 1 μm in thickness is formed on a silicon substrate 40. Thereafter, a first metal conductive layer 44 comprised of aluminum or a multi-layer film including aluminum (for example, Al+TiW) is subjected to patterning so as to have a thickness of 0.7 μm (see FIG. 2A). It is desirable that different metal conductive layer is applied on aluminum in order to restrain contact resistance between the heating resistor and the metal conductive layer.

Next, an interlayer insulating film 46 is formed so as to have a thickness of 1 μm. A photo-resist 48 (manufactured by Tokyo Ohka Kogyo Co., trade name: OFPR-800) is spin-coated on the interlayer insulating film 46 and subjected to exposure and development to carry out patterning (see FIG. 2B).

Subsequently, dry etching using fluorine gas is carried out with the photo-resist 48 used as a mask, thereafter, removing the photo-resist 48 by oxygen plasma and forming a contact portion in which the first metal conductive layer 44 is exposed in the interlayer insulating film 46. Further, a second metal conductive layer 52 comprised of aluminum alloy is deposited so as to have a thickness of 0.5 μm and a photo-resist 50 is coated thereon and subjected to exposure and development (see FIG. 2C). Dry etching using chlorine-based gas is carried out, and thereafter, the photo-resist 50 is removed.

Next, a first interlayer insulating film 54 (P—SiN film) is deposited by CVD (chemical vapor deposition) so as to have a thickness of about 0.1 to 0.2 μm, and a second interlayer insulating film 56 (P—SiO film) is deposited thereon so as to have a thickness of about 0.8 to 0.9 μm. Further, a photo-resist 58 is patterned on the second interlayer insulating film 56 (see FIG. 2D).

Figure 2A:
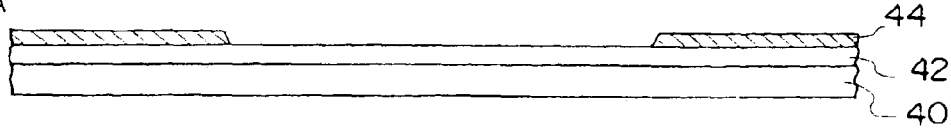
FIGS. 2A to 2H are cross-sectional views which show a method for manufacturing an ink-jet recording head according to a second embodiment of the present invention.
Figure 2B:
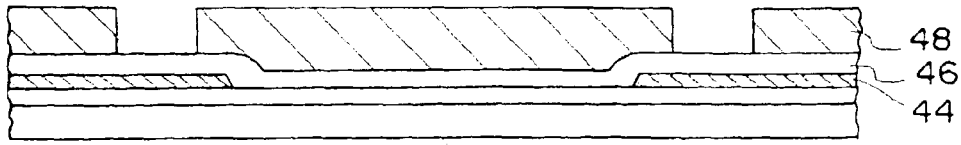
Figure 2C:
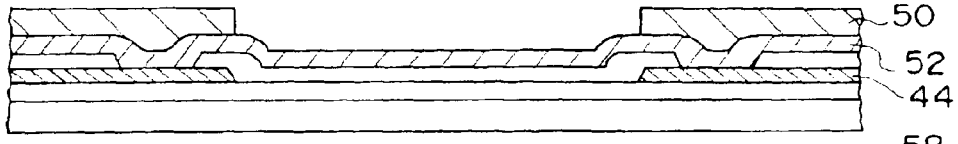
Figure 2D:
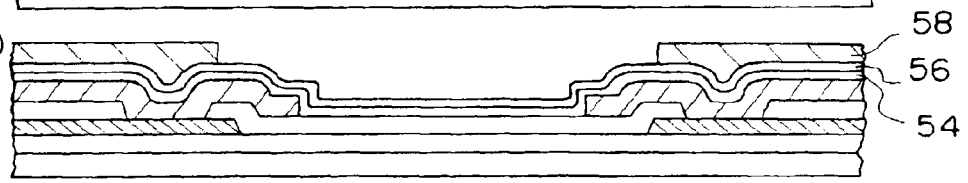

When an opening process (etching) is carried out to define an area in which a heating resistor 60 (described later) and the second metal conductive layer 52 are brought into contact with each other, the interlayer insulating film 46 is scraped (etched) due to uneven etching (see FIG. 2D to FIG. 2E). This is because, in order to reliably remove the first interlayer insulating film 54 and the second interlayer insulating film 56 so as to prevent contact failure between the second metal conductive layer 52 and the heating resistor 60, etching is carried out more than necessary in consideration of variations in film thickness of the first interlayer insulting film 54 and the second interlayer insulating film 56. The variations in film thickness of the film disposed below the heating resistor 60 causes variation in heating efficiency of the heating resistor 60, thereby affecting print quality.

Figure 2E:
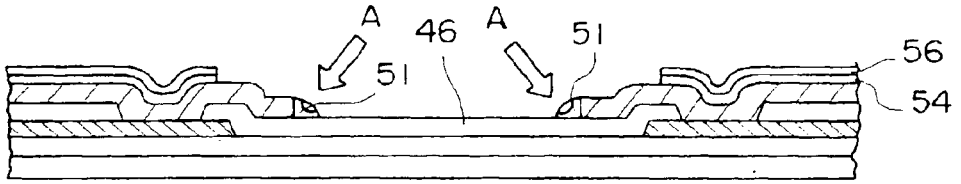
Figure 2F:
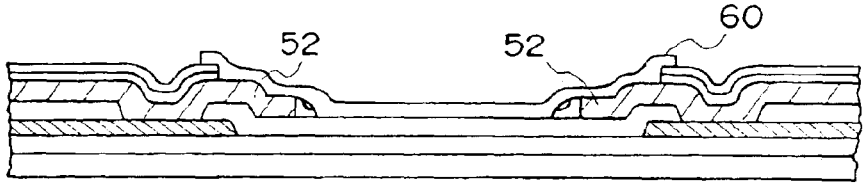
Figure 2G:
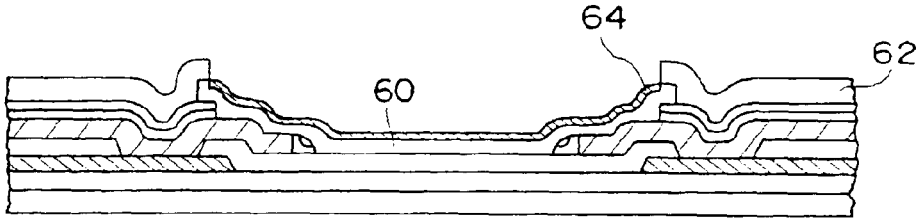

In order to avoid this problem, when the first interlayer insulating film 54 and the second interlayer insulating film 56 are subjected to dry etching using fluorine-based gas with the photo-resist 58 used as a mask, the etching is carried out while a wavelength of CO (carbon monoxide) generated by a reaction between oxygen from P—SiO of the second interlayer insulating film 56 and carbon (C) in etching gas (see FIG. 2E).

When the second interlayer insulating film 56 is removed by etching and the first interlayer insulating film 54 is exposed, oxygen (O) is no longer generated. Therefore, carbon monoxide intensity is lowered and end-point detection can be carried out precisely. Further, the first interlayer insulating film 54 and the second interlayer insulating film 56 remain at the portion indicated by arrow A to form a step-difference alleviating portion 51, and an edge portion of the second metal conductive layer 52 is in a smoothly tapered shape, thereby making it hard to cause breaking of the heating resistor 60 (described later).

Next, the surface is lightly subjected to etching (reverse spattering) with Ar gas. As a result, contact resistance between the second metal conductive layer 52 and the heating resistor 60 (described later) can be reduced. Further, the step-difference alleviating portions 51 (indicated by arrow A of FIG. 2E) are formed in a smoothly tapered shape so that the degree of the stepped portion is reduced, thereby bringing about a secondary effect in which breaking of the heating resistor 60 is hard to occur.

Subsequently, the heating resistor 60 made of TaSiO is formed by spattering (film depositing) so as to have a thickness of 0.1 $\mu$m. After the film deposition, a resist is patterned and etching using fluorine-based gas is carried out (see FIG. 2F).

Furthermore, a protective film 62 (interlayer insulating film) made of P—SiO and having a thickness of 0.5 $\mu$m is deposited and patterned by etching, and thereafter, subjected to heat treatment at the temperature of about 450° C. for several tens of minutes in the presence of oxygen. As a result, a thin oxide film 64 (a self-oxidized protective film) is formed on the surface of the heating resistor 60 which is not covered by the protective film 62 (see FIG. 2G).

Figure 2H:
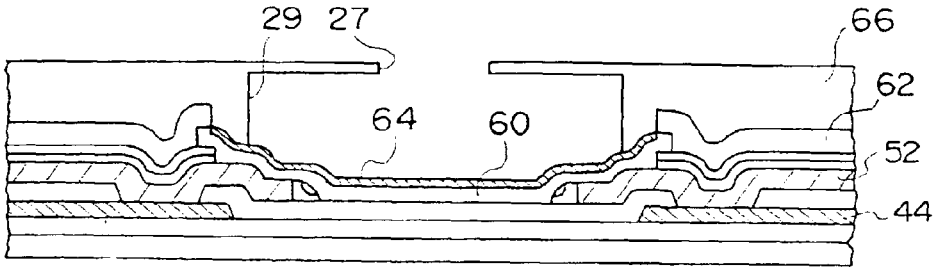
Figure 3:
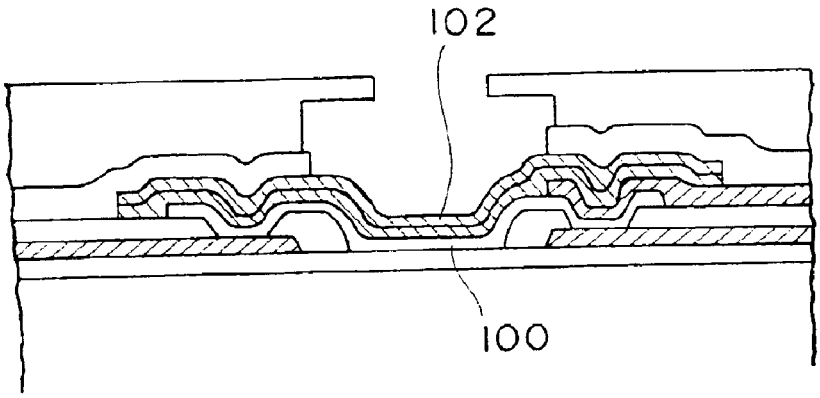
FIG. 3 is a cross-sectional view of a conventional ink-jet recording head.
Figure 4:
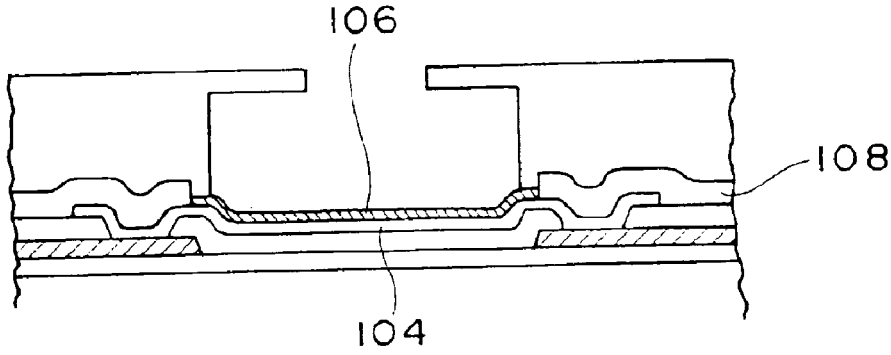
FIG. 4 is a cross-sectional view of another conventional ink-jet recording head.

Finally, an ink flow channel 29 and a nozzle 27 are formed by resin 66 (see FIG. 2H).

In the present embodiment, the protective film 62 is deposited. However, this process may be omitted depending on the circumstances.

Since the present invention has the aforementioned structure, metal conductive layer material having excellent energy efficiency and typified by Al, which is generally used as semiconductor materials, can be used.

What is claimed is:

1. An ink-jet recording head comprising:

a substrate;

a first conductive layer provided on the substrate;

an insulating layer provided on the first conductive layer;

a second conductive layer formed on the insulating layer and coming into contact with the first conductive layer; and a heat generation layer disposed on the second conductive layer and having, on a surface thereof, a self-oxidized protective film as an ink-contact interface.

2. An ink-jet recording head according to claim 1, wherein at least one of the first and second conductive layers is metal which includes, as a principal component, aluminum or aluminum alloy.

3. An ink-jet recording head according to claim 1, wherein the heat generation layer is a TaSiO film.

4. An ink-jet recording head comprising:

a substrate;

a first conductive layer provided on the substrate;

an insulating layer provided on the first conductive layer;

a second conductive layer formed on the insulating layer and coming into contact with the first conductive layer; and a heat generation layer disposed on the second conductive layer and having, on a surface thereof, a self-oxidized protective film as an ink-contact interface, wherein a portion is formed, which portion alleviates a stepped portion formed by an edge of the second conductive layer and the insulating layer.

5. An ink-jet recording head according to claim 4, wherein at least one of the first and second conductive layers is metal which includes, as a principal component, aluminum or aluminum alloy.

6. An ink-jet recording head according to claim 4, wherein the heat generation layer is a TaSiO film.

7. An ink-jet recording head according to claim 4, wherein the step-difference alleviating portion is formed by laminated insulating films comprised of different compositions formed on the second conductive layer.

8. An ink-jet recording cartridge equipped with an ink-jet recording head comprising:

a substrate;

a first conductive layer provided on the substrate;

an insulating layer provided on the first conductive layer;

a second conductive layer formed on the insulating layer and coming into contact with the first conductive layer; and a heat generation layer disposed on the second conductive layer and having, on a surface thereof, a self-oxidized protective film as an ink-contact interface.

9. An ink-jet recording cartridge according to claim 8, wherein, in the inkjet recording head, a portion is formed, which portion alleviates a stepped portion formed by an edge of the second conductive layer and the insulating layer.

10. An ink-jet recording device equipped with an ink-jet recording cartridge equipped with an ink-jet recording head comprising:

a substrate;

a first conductive layer provided on the substrate;

an insulating layer provided on the first conductive layer;

a second conductive layer formed on the insulating layer and coming into contact with the first conductive layer; and a heat generation layer disposed on the second conductive layer and having, on a surface thereof, a self-oxidized protective film as an ink-contact interface.

11. An ink-jet recording device according to claim 10, wherein, in the ink-jet recording head, a portion is formed, which portion alleviates a stepped portion formed by an edge of the second conductive layer and the insulating layer.

* * * * *